US011230990B2

(12) United States Patent
Puckett et al.

(10) Patent No.: US 11,230,990 B2
(45) Date of Patent: Jan. 25, 2022

(54) METHOD AND SYSTEM FOR VALVE MOVEMENT DETECTION

(71) Applicant: Caterpillar Inc., Peoria, IL (US)

(72) Inventors: Daniel R. Puckett, Peoria, IL (US); Kranti K. Nellutla, Dunlap, IL (US); Gregory L. Armstrong, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 155 days.

(21) Appl. No.: 16/680,247

(22) Filed: Nov. 11, 2019

(65) Prior Publication Data

US 2021/0140386 A1 May 13, 2021

(51) Int. Cl.

| | |
|---|---|
| ***F02D 41/38*** | (2006.01) |
| ***F02D 41/20*** | (2006.01) |
| ***F02D 41/14*** | (2006.01) |
| ***F02M 63/00*** | (2006.01) |
| ***F02M 45/00*** | (2006.01) |

(52) U.S. Cl.

CPC ..... *F02D 41/3863* (2013.01); *F02D 41/1406* (2013.01); *F02D 41/20* (2013.01); *F02M 45/00* (2013.01); *F02M 63/0015* (2013.01); *F02D 2041/2055* (2013.01); *F02D 2041/2058* (2013.01)

(58) Field of Classification Search

CPC ..... F02D 41/14; F02D 41/1406; F02D 41/38; F02D 41/3836; F02D 41/20; F02D 41/221; F02D 41/062; F02D 41/36; F02D 41/3845; F02D 2041/2055; F02D 2041/225; F02D 2041/3881; F02M 21/0245; F02M 37/0052; F02M 43/04; F02M 45/00; F02M 55/025; F02M 59/34; F02M 61/14; F02M 63/00; F02M 63/0015; F02M 63/0029; Y02T 10/30

USPC ..... 123/472–481, 490

See application file for complete search history.

(56) References Cited

U.S. PATENT DOCUMENTS

| | | | | |
|---|---|---|---|---|
| 7,917,310 | B2 | 3/2011 | Pearce et al. | |
| 8,214,132 | B2 | 7/2012 | Bunni et al. | |
| 9,441,594 | B2 * | 9/2016 | Ayanji | F02D 41/20 |
| 10,941,738 | B1 * | 3/2021 | Puckett | F02M 47/027 |
| 2008/0092853 | A1 * | 4/2008 | Harcombe | F02M 59/366 123/472 |

(Continued)

FOREIGN PATENT DOCUMENTS

| | | | |
|---|---|---|---|
| CN | 102536566 | B | 7/2012 |
| JP | 2018-145804 | A | 9/2018 |

(Continued)

*Primary Examiner* — John Kwon
*Assistant Examiner* — Johnny H Hoang
(74) *Attorney, Agent, or Firm* — Bookoff McAndrews PLLC

(57) ABSTRACT

A fuel injection method includes applying a first method current to close a spill valve according to a first method, applying a control valve current to open a control valve, and discontinuing the application of the control valve current to thereby cause the control valve to close. The method also includes applying a second method current to maintain the spill valve closed according to a second method and detecting a timing of a closing of the control valve while applying the second method current according to the second method, the second method being different than the first method.

20 Claims, 3 Drawing Sheets

(56) References Cited

U.S. PATENT DOCUMENTS

| | | | | |
|---|---|---|---|---|
| 2008/0202471 | A1* | 8/2008 | Yudanov | F02M 21/0245 123/446 |
| 2009/0314259 | A1* | 12/2009 | Coldren | F02M 57/021 123/473 |
| 2016/0076498 | A1* | 3/2016 | Aono | F02D 41/2467 123/490 |
| 2016/0177855 | A1* | 6/2016 | Kusakabe | F02D 41/20 123/490 |
| 2016/0186683 | A1* | 6/2016 | Lee | F02D 41/402 123/478 |
| 2018/0112614 | A1* | 4/2018 | Makino | F02D 41/20 |
| 2018/0283306 | A1* | 10/2018 | Kusakabe | F02D 41/402 |
| 2018/0328308 | A1* | 11/2018 | Iwano | F02M 59/20 |
| 2020/0182185 | A1* | 6/2020 | Hoover | F02M 43/04 |

FOREIGN PATENT DOCUMENTS

| | | | |
|---|---|---|---|
| KR | 20130059374 | A | 6/2013 |
| WO | 2018/185314 | A1 | 10/2018 |

* cited by examiner

METHOD AND SYSTEM FOR VALVE MOVEMENT DETECTION

TECHNICAL FIELD

The present disclosure relates generally to systems for internal combustion engines, and more particularly, to methods and systems for valve movement detection in a fuel injector of an internal combustion engine.

BACKGROUND

Many internal combustion engines include electronic control units that monitor and operate aspects of the operation of the engine, including the timing and quantity of fuel injection. Engine control units perform these operations with the use of a series of maps, or other programming, stored in memory of the control unit. In conjunction with these maps or programs, control units receive and calculate various items of feedback representative of the operation of the engine. Some engines employ fuel injectors that each have multiple electronically-controlled valves. These valves transition between closed and open positions by selectively energizing actuators, such as solenoids, within each injector. These fuel injector solenoids may be connected to a power supply controlled by the control unit. Some control units may be programmed to detect movement of the valves. For example, when solenoids are deactivated, the control unit may detect movement of a valve member based on free-wheeling current generated in the solenoid (e.g., current induced by movement of a valve member returning to a resting position). The solenoids may be positioned in close proximity to each other to satisfy size constraints of the injector. However, drive currents of such closely-positioned solenoids in a fuel injector may introduce noise or cross-talk. This cross-talk may impair the ability of the control unit to accurately detect aspects of the fuel injector, such as movement of one or more valves.

A method of detecting a valve opening or closing event is disclosed in International Publication No. WO 2018/185314 A1 (the '314 publication) to Sykes. The method described in the '314 publication involves applying a voltage to a solenoid and sampling the current through the solenoid to determine the start of injection. The method of the '314 publication involves applying a continuously-chopped current so that a system for injecting reductant can be used in conjunction with a high voltage power supply. While the method of the '314 publication may be useful in some circumstances, it may not be useful in systems in which two or more solenoids are disposed in close proximity to each other and subject to cross-talk.

The disclosed method and system may solve one or more of the problems set forth above and/or other problems in the art. The scope of the current disclosure, however, is defined by the attached claims, and not by the ability to solve any specific problem.

SUMMARY

In one aspect, a fuel injection method may include applying a first method current to close a spill valve according to a first method, applying a control valve current to open a control valve, and discontinuing the application of the control valve current to thereby cause the control valve to close. The method may also include applying a second method current to maintain the spill valve closed according to a second method, and detecting a timing of a closing of the control valve while applying the second method current according to the second method, the second method being different than the first method.

In another aspect, a fuel injection method for a mechanically-actuated electronically-controlled fuel injector having a spill valve and a control valve may include applying a chopped spill valve current to close the spill valve according to a first method, applying a control valve current to cause a control valve member of the control valve to move from a first position to a second position, and stopping the application of the control valve current to cause the control valve member to return to the first position from the second position. The method may also include switching the chopped spill valve current to a non-chopped spill valve current to maintain the spill valve closed, according to a second method, and detecting a timing of the return of the control valve member to the first position while applying the non-chopped spill valve current.

In yet another aspect, a fuel injection control system may include at least one power source, a fuel injector including a spill valve including a spill valve solenoid and a control valve including a control valve solenoid, and a controller. The controller may be configured to apply a first method current to the spill valve solenoid according to a first method, apply a control valve current to open a control valve, and discontinue the application of the control valve current to the control valve solenoid to cause the control valve to close. The controller may also be configured to apply a second method current to hold the spill valve closed according to a second method, and detect a timing of a closing of the control valve while applying the second method current, wherein the second method has a lower cross-talk potential than the first method.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
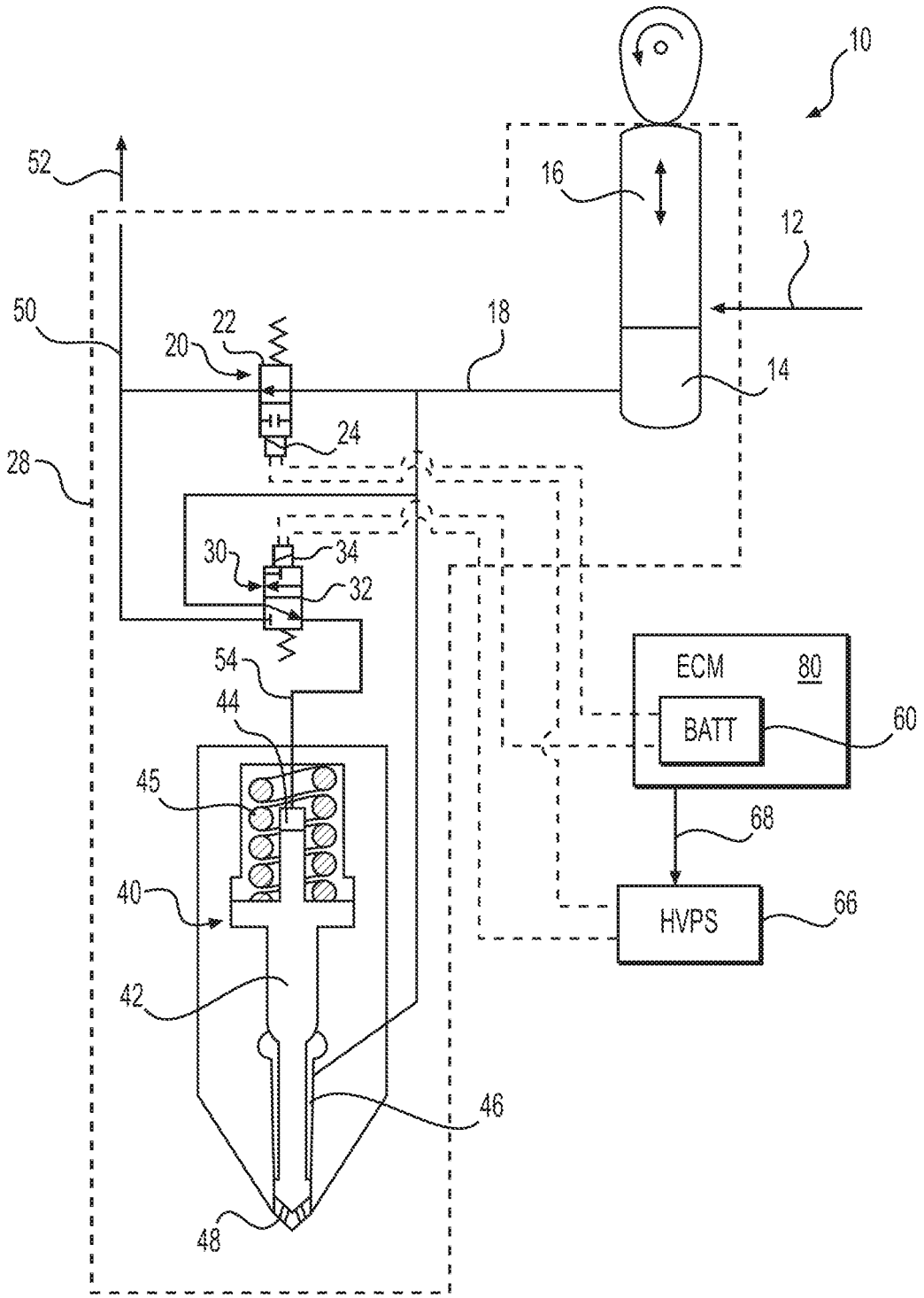
FIG. 1 is a schematic diagram illustrating a fuel injector of an engine system according to an aspect of the present disclosure.

FIG. 1 is a schematic diagram illustrating a fuel injection system 10 according to an aspect of the present disclosure. Fuel injection system 10 may be a component of an internal combustion engine, for example, and may include a fuel injector 28, a first power source such as a high-voltage power source (HVPS) 66, and an electronic control module (ECM) 80. Fuel injector 28 may be a mechanically-actuated electronically-controlled unit injector including a fuel reservoir 14 that receives fuel from a fuel source 12 and includes a cam-actuated piston 16 to pressurize fuel within reservoir 14. A high-pressure fuel channel 18 may extend from fuel reservoir 14 to provide pressurized fuel to a spill valve 20, a direct-operated control (DOC) valve 30, and a check valve 40 (via check valve chamber 46) of the fuel injector 28. A low-pressure fuel channel 50 may extend individually from spill valve 20 and DOC valve 30, to a fuel return passage 52 which may recirculate and return fuel to fuel source 12. Spill valve 20 and DOC valve 30 may respectively include a spill valve solenoid 24 and a DOC valve solenoid 34 that are electrically connected to a high-voltage power supply (HVPS) 66 and a second power source or battery 60 of an electronic control module (ECM) 80. ECM 80 may be configured to output command signals to power circuits of battery 60 and/or HVPS 66, (which may include voltage-boosting circuitry, such as a capacitor circuit and a power source such as a battery) to selectively energize (provide electrical power to) solenoids 24 and 34. In FIG. 1, solid lines (e.g., between valves 20, 30, 40, and fuel reservoir 14 or fuel return passage 52) represent fuel passages, while dashed lines represent electrical communication lines or conductors. While shown separately in FIG. 1, spill valve 20, DOC valve 30, and check valve 40 may be provided in respective bodies within a single housing of fuel injector 28. While battery 60 is shown as a component of ECM 80, battery 60 may be provided separately form ECM 80.

Spill valve 20 may be a normally-open, two-way, two-position valve. When spill valve 20 is open, a spill valve member 22 may be positioned to permit communication between high-pressure fuel channel 18 and low-pressure fuel channel 50. Spill valve member 22 may be biased toward an open position by a spring member, for example. A position of spill valve 20 may be controlled by energizing an actuator, such as spill valve solenoid 24, to generate a magnetic field that controls a motion of spill valve member 22. For example, spill valve 20 may be closed when spill valve solenoid 24 is energized by either battery 60 or HVPS 66.

DOC valve 30 may be a normally-closed, three-way, two-position valve. In a first position of DOC valve 30 illustrated in FIG. 1, referred to as a closed position herein, DOC valve member 32 may be positioned so as to permit communication between a control chamber 44 of check valve 40 and high-pressure fuel channel 18 (via a control chamber passage 54) and block communication between control chamber 44 and low-pressure fuel channel 50. DOC valve member 32 may be biased toward this closed position by a spring member. In a second (open) position, DOC valve member 32 may block communication between control chamber 44 and high-pressure fuel channel 18, and permit communication between control chamber 44 and low-pressure fuel channel 50.

Check valve 40 may be a one-way needle valve including a needle valve member 42 configured to block or allow communication between a check valve chamber 46 and injection orifices 48. A spring member 45 may bias needle valve member 42 toward the closed position illustrated in FIG. 1. Additionally, needle valve member 42 may be biased towards the closed position when control chamber 44 of check valve 40 is in communication with high-pressure passage 18. Needle valve member 42 may move from this closed position to an open position when DOC valve 30 opens (and while spill valve 20 is closed). For example, when spill valve 20 is closed and DOC valve 30 is open, control chamber 44 may be at a low pressure, thereby allowing pressure within check valve chamber 46 to act against a biasing force of spring member 45 and inject fuel through orifices 48.

Figure 3:
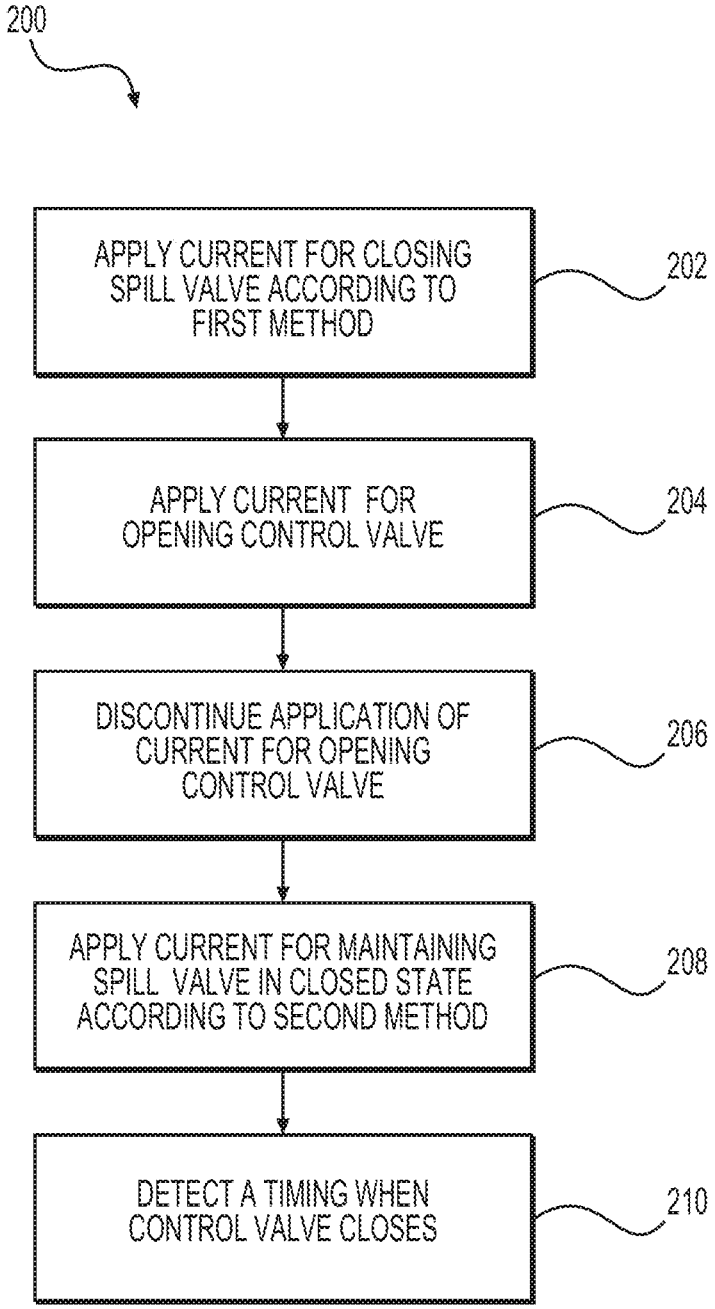
FIG. 3 is a flowchart of a method for detection a motion of a spill valve of the fuel injector according to an aspect of the present disclosure.

ECM 80 may be configured to receive various sensed inputs and generate commands or control signals to control the operation of a plurality of fuel injectors 28. ECM 80 may embody a single microprocessor or multiple microprocessors that receive inputs and issue control signals, including commands for circuitry of battery 60 and commands 68 for controlling circuitry of HVPS 66. These commands may allow ECM 80 to selectively energize solenoids 24, 34 with electrical power from battery 60, HVPS 66, or both. ECM 80 may include a memory, a secondary storage device, a processor, such as a central processing unit or any other means for accomplishing a task consistent with the present disclosure. The memory or secondary storage device associated with ECM 80 may store data and software to allow ECM 80 to perform its functions, including the functions described below with respect to method 200 (FIG. 3). In particular, such data and software in memory or secondary storage device(s) may allow ECM 80 to perform any of the adaptive trim and signal (current) analysis described herein. Numerous commercially available microprocessors can be configured to perform the functions of ECM 80. Various other known circuits may be associated with ECM 80, including signal-conditioning circuitry, communication circuitry, and other appropriate circuitry.

INDUSTRIAL APPLICABILITY

Fuel injection system 10 may be used in conjunction with any appropriate machine or vehicle that includes an internal combustion engine. In particular, fuel injection system 10 may be used in any internal combustion engine in which two or more solenoids, such as a spill valve solenoid and a control valve solenoid of a fuel injector, could be subject to cross-talk (e.g., due to being placed in proximity to each other). Moreover, fuel injection system 10 may be used in any internal combustion engine in which it may be desirable to determine a timing at which a valve changes state (e.g., to a closed position) based on free-wheeling current generated by a solenoid for a control valve.

During an operation of an internal combustion engine, fuel injection system 10 may direct fuel, such as diesel fuel, into a combustion chamber of the engine. Each fuel injector 28 may inject fuel during one or more injection events of a cycle of engine 10. For example, fuel injection system 10 may be configured to inject fuel once, twice, or three times during a single cycle of the engine. A largest amount of fuel, as measured in fuel mass, may be injected during a main injection. One or more smaller injection events may occur before or after the main injection. An injection that occurs before the main injection may form a pilot injection, while an injection that occurs after the main injection may form a post injection. A pilot injection that occurs shortly before the main injection may be referred to as a close-coupled pilot injection, while a post injection that occurs shortly after the main injection may be referred to as a close-coupled post injection. Fuel injection system 10 may, while the internal combustion engine is operating, continuously monitor the operation of fuel injector 28 and adjust the timing of the pilot, main, and/or post injections based on feedback or sensed information and operator commands.

Figure 2:
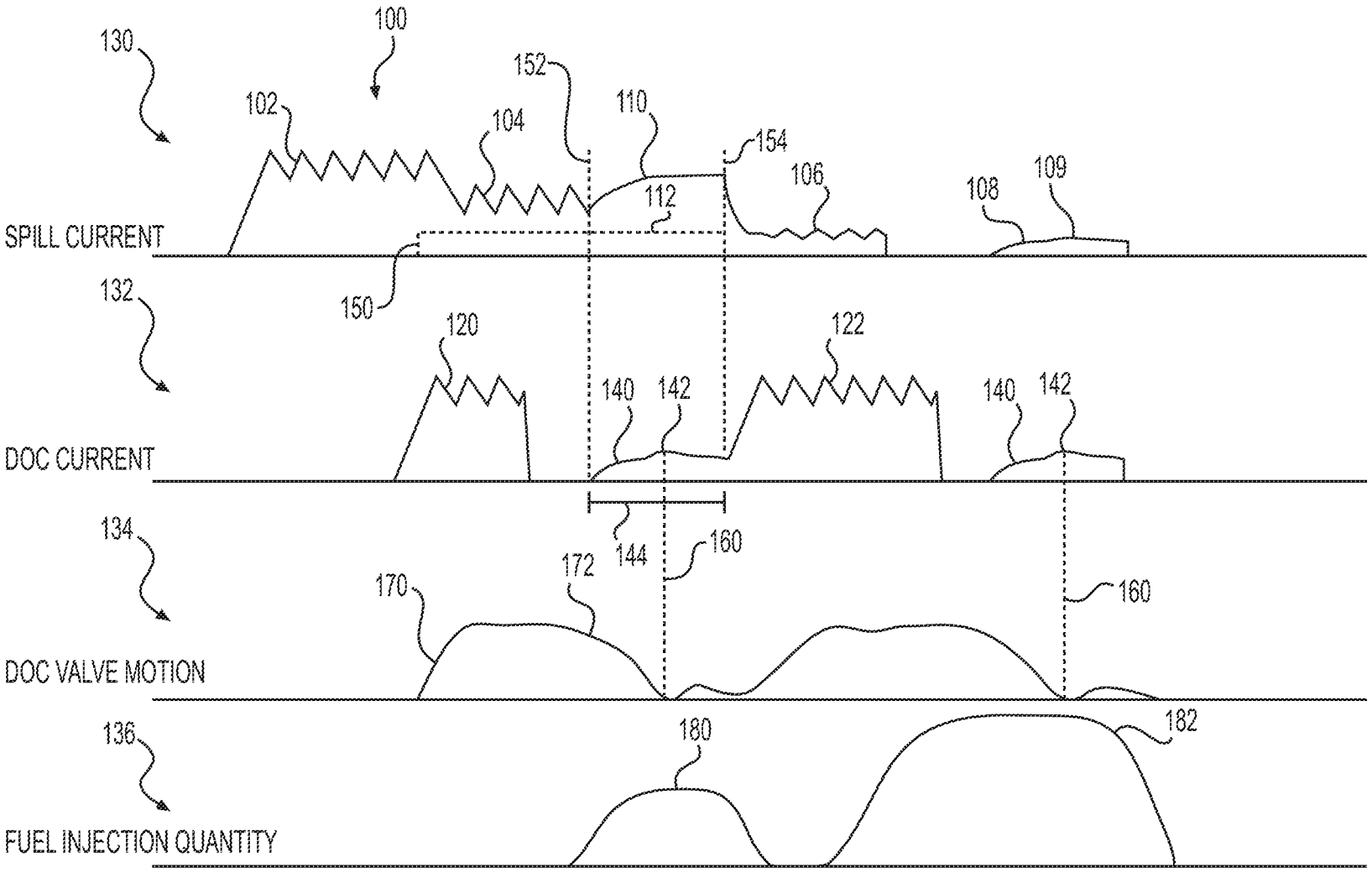
FIG. 2 is a chart illustrating a correlation of operational aspects of the fuel injector of FIG. 1, including waveforms of a current through a circuit of a spill valve, a motion of a spill valve member, a current through a circuit of a DOC valve, and a motion of a DOC valve member.

FIG. 2 is a chart illustrating exemplary current waveforms, DOC valve motion, and quantity of injected fuel during exemplary close-coupled pilot and main injections of injector 28. A first current waveform 130 of FIG. 2 represents an exemplary amount of current that passes through spill valve solenoid 24 to facilitate these injections. As discussed above, the application of current to solenoid 24 may cause the spill valve 20 to move to (and be held in) a closed position preventing high-pressure fuel from entering low-pressure fuel channel 50. This waveform also illustrates an exemplary amount of current (current 108) that is generated in solenoid 24 due to free-wheeling of spill valve member 22, as described below. The chart of FIG. 2 further shows a second current waveform 132 below the spill current waveform 130, this waveform corresponding to an exemplary amount of current that is applied to DOC valve solenoid 34 to move DOC valve member 32 to an open position that is associated is an injection of fuel. FIG. 2 further provides corresponding plot of motion 134 of DOC valve member 32, and of a quantity of injected fuel 136 in the third and fourth lower portions of FIG. 2, respectively. Each of the four portions (x-axes) of FIG. 2 correspond to the same period of time.

With reference to the spill current waveform 130 illustrated in FIG. 2, an injection event may begin with the application of chopped spill valve (first method) current 100. Chopped current may be a current that is regularly interrupted or cycled between connected and disconnected states so as to provide an approximately constant average amount of current. This chopped spill valve current may be applied, for example, via HVPS 66 in accordance with a command from ECM 80. In order to overcome the resistance of the spring member, an initial level 102 of chopped current 100 may be applied to spill valve solenoid 24. In one aspect, once this initial resistance has been overcome, spill valve member 22 may reach a closed position (e.g., at timing 150). An amplitude of chopped current 100 may be reduced from a pull-in or initial level 102 to a keep-in or intermediate level 104 following timing 150. As intermediate level 104 is greater than a minimum threshold current 112 necessary for maintaining spill valve member in the closed position, spill valve 20 may remain closed, preventing high-pressure fuel from flowing to low-pressure fuel channel 50. Intermediate level 104 may have a magnitude sufficient to draw DOC valve member 32 to a stop or seat of DOC valve 30, and to overcome the tendency of DOC valve member 32 to bounce at this stop. At a later time, a third, hold-in or minimum current level 106 may be applied following intermediate level 104. These three levels 102, 104, 106, of chopped current 100 may be applied as part of a first method or program executed by ECM 80. Chopping may be performed by the first program in order to avoid over-saturating spill valve solenoid 24 with current, and to avoid over-heating solenoid 24, during the application of one or more of initial level 102 or intermediate level 104. Chopping may be performed during the application of minimum current level 106 to ensure that the spill valve remains closed or held-in, prevent unnecessary heating of solenoid 24, avoid wasting current, and ensure that current (and force) decay in solenoid 24 is fast and consistent once current level 106 is no longer applied. This may be performed due to the high voltage applied by HVPS 66, for example. Once current is no longer applied to solenoid 24 (e.g., at the termination of minimum current level 106) valve member 24 may return to the closed position. The travel of valve member 24 from the closed position to the open position may induce a detectable free-wheeling current 108 (e.g., via a free-wheeling circuit monitored by ECM 80). ECM 80 may be configured to detect a return of the spill valve member 22 to the open state based on a peak 109 of free-wheeling current 108.

With continued reference to the spill valve current waveform of FIG. 2, ECM 80 may perform a second method or program that maintains or holds spill valve member 24 in the closed position. In one aspect, this second program may, together with the first program, be part of a strategy for controlling spill valve 20. The second program may have a lower cross-talk potential (may reduce cross-talk or noise) as compared to the first method, and may differ from the first program in that chopped current is not applied during the second program. For example, the second program may prevent or avoid the occurrence of cross-talk that may be associated with the application of chopped current. Such cross-talk may interfere with the detection of free-wheeling current generated by, e.g., motion of DOC valve member 32. Therefore, the second program may facilitate detection of free-wheeling current associated with DOC valve 30 to allow ECM 80 to detect a timing at which DOC valve member 32 returns to a resting position. This second program may be applied between a first timing 152 until a second timing 154. The second program may include, for example, transitioning or switching from the chopped current 100 to a non-chopped (second method) current 110 at timing 152. This non-chopped current 110 may be provided by disconnecting HVPS 66 from solenoid 24, and instead connecting (switching to) battery 60, which may have a lower voltage than HVPS 66, to solenoid 24. Battery 60 may remain connected to solenoid 24 until a second timing 154, for example. Battery 60 may have a sufficient voltage to maintain a non-chopped current 110 above threshold current 112 required to keep spill valve 20 closed.

As shown in the second waveform 132 of FIG. 2, ECM 80 may apply chopped current to DOC valve solenoid 34. In an exemplary injection strategy, ECM 80 energizes DOC valve solenoid 34 while spill valve 20 is closed to perform a close-coupled pilot injection by applying pilot injection chopped current 120 to DOC valve solenoid 34. DOC valve member 32 may move as represented by opening motion 170, from a closed position to an open position. When pilot current 120 is no longer applied and the current decays, DOC valve 32 may move according to closing motion 172. This closing motion 172 may induce a detectable free-wheeling current 140. This free-wheeling current may be generated during a free-wheeling window 144 at which the motion of DOC valve member 32 is detectable by ECM 80 by monitoring free-wheeling current 140. Based on the detected free-wheeling current 140, ECM 80 may be configured to detect the motion of DOC valve member 32. For example, ECM 80 may determine that DOC valve member 32 reaches the closed position when a peak free-wheeling current 142 is detected during window 144. For example, ECM 80 may determine (sense) a DOC valve closure timing 160 that corresponds to the timing of peak free-wheeling current 142.

In order to ensure detection of free-wheeling current 140, ECM 80 may be configured to adjust first timing 152 and second timing 154 during which the second program of the control strategy is performed. In one aspect, first timing 152 may be approximately the same timing as the beginning of window 144. However, the exact timing 152 may be earlier than window 144, if desired. ECM 80 may adjust timings 152, 154, and the amount of time between timings 152, 154. For example, when timing 152 is later than the beginning of the rise of free-wheeling current 140, a beginning of free-wheeling current 140 may be truncated (not detected). Thus, ECM 80 may adjust first timing 152 to an earlier timing in a subsequent injection. If timing 154 occurs prior to the end of free-wheeling current 140, timing 154 may be advanced in a subsequent injection. Moreover, if ECM 80 determined that the amount of time between timings 152, 154 is too short (free-wheeling current is truncated) or too long, timings 152, 154 may be performed closer together or farther apart, respectively. Thus, timings 152, 154 may be dynamic, and may be based on one or more previous detections of free-wheeling current 140 to minimize delays between timings 152, 154 and window 144.

As can be seen in FIG. 2, a pilot injection 180 may be performed due to the above-described control of spill and DOC valves 20 and 30, and may at least partially overlap the second program (a timing at least partially overlapping a duration of time defined by first and second timings 152, 154). A subsequent main injection 182 may be controlled in a similar manner to inject a larger amount of fuel. For example, minimum current level 106 may be applied to maintain spill valve 20 closed prior to the main injection, while chopped current 122 may be applied to drive the main injection. In one aspect, one or more post injections (which may include one or more close-coupled post injections) may be performed following main injection 182. The post injection may be performed by energizing the spill and DOC solenoids 24, 34 in a manner similar to that described with respect to the pilot injection. For example, the post injection may include holding spill valve member 22 in a closed position during and after the main injection. ECM 80 may perform the second program between the main injection and the post injection, in a similar manner as described above for the performance of a second program between the pilot and main injections.

In injection patterns where pilot, main, and post injections are all applied in a single combustion cycle, ECM 80 may be configured to apply the second program between the pilot and main injections for a first combustion cycle, and between the main and post injections for a second combustion cycle. Thus, the timing of the second program may change, or alternate, between different injection cycles. Alternatively, the second program may be applied twice during a single combustion cycle, once between the pilot and main injections, and again between main and post injections, if desired. A similar process may be employed when injection events vary over time. For example, a first injection event may include close-coupled pilot and main injections, while a second injection event may include main and close-coupled post injections. ECM 80 may detect valve closure timing 160 between each of these events in each injection cycle.

ECM 80 may be configured to adjust the timings of pilot, main, and/or post injections based on the detected valve closure timing 160. For example, ECM 80 may be configured to adjust a dwell time or a duration of time between a pilot injection and a main injection, or between the main injection and the post injection. Additionally or alternatively, ECM 80 may adjust a duration of an injection for one or more of the pilot injection, main injection or post injection. In particular, the duration and/or dwell may be adjusted based on a difference between the detected valve closure timing 160 and an expected valve closure timing. Thus, adaptive trim may be performed continuously (or intermittently at predetermined intervals) to monitor and adjust the precise timings and injection strategy for operating injectors 28.

While the second program may include the application of battery 60, the use of battery 60 during the second program may be avoided by instead increasing a level of chopped current 100 above that of the initial level 102 at a timing immediately prior to first timing 152. Then, at timing 152, the second program may de-energize solenoid 24. In this exemplary alternative second method, due to the increased amount of current applied immediately prior to first timing 152, the current may decay relatively slowly, maintaining spill valve member 22 in the closed position until second timing 154 at which chopped current 100 may again be applied (as minimum current 106). Regardless of the action taken to execute the second method, chopped current is not applied for at least a portion of the period of time extending from first timing 152 to second timing 154. Additionally, while intermediate 104 and minimum 106 current levels are illustrated are shown as being separate, the application of minimum current level 106 may occur earlier (e.g., at least partially prior to first timing 152).

FIG. 3 illustrates an exemplary method 200 that may be performed by fuel injection system 10, and in particular, by ECM 80. In a first step 202, current may be applied to close spill valve 20 according to a first method or program. This may be performed by applying a chopped current 100, as described above. In a step 204, current may be applied to open a control valve, such as DOC valve 30. For example, as described above, chopped DOC current 120 for performing a pilot injection (or chopped DOC current 122 for performing a main injection) may be applied. In step 206, once a quantity of current sufficient to energize DOC solenoid 34 for an injection event has been delivered, the application of chopped current 120 or 122 may be discontinued. During a step 208, current may be applied to the to maintain spill valve 20 closed according to a second method or program. This second program may include, for example, switching to a non-chopped current source such as a battery, or increasing an amplitude of chopped current and subsequently discontinuing the application of chopped current. The second program may terminate when the measurement of the movement of DOC valve member 32 is complete. In a step 210, a timing at which a control valve such as DOC valve 30 closes may be detected based on a peak of a detected free-wheeling current in DOC solenoid 34. This may be performed concurrently with step 208. In one aspect, spill valve 20 may remain closed throughout steps 202, 204, 206, and 208.

In some fuel injectors, the proximity between two or more solenoids may interfere with or prevent current sensing when chopped current is employed. For example, detection of a return timing of a control valve member may be challenging when a close-coupled pilot or a close-coupled post injection is performed, particularly when free-wheel measurements are employed. For example, noise may be introduced by the current chopping. This noise may cause false detection signals. By transitioning to a second program, which may include switching from a chopped current to a non-chopped current, it may be possible to detect a timing of an opening or closing of a valve with increased accuracy. This information may allow for precise control over valve trim, allowing ECM 80 to modify injection timings with increased precision. In one aspect, accurate valve return information may allow for improved injection size and dwell control. This improved control may improve engine performance, reduce emissions of pollutants, reduce noise, and improve the durability of the engine.

It will be apparent to those skilled in the art that various modifications and variations can be made to the disclosed method and system without departing from the scope of the disclosure. Other embodiments of the method and system will be apparent to those skilled in the art from consideration of the specification and practice of the apparatus and system disclosed herein. It is intended that the specification and examples be considered as exemplary only, with a true scope of the disclosure being indicated by the following claims and their equivalents.

What is claimed is:

1. A fuel injection method, comprising:

applying a first method current to close a spill valve according to a first method;

applying a control valve current to open a control valve;

discontinuing the application of the control valve current to thereby cause the control valve to close;

applying a second method current to maintain the spill valve closed according to a second method;

generating an induced current due to motion of a control valve member of the control valve as the control valve member moves to a position that closes the control valve; and detecting a timing at which the control valve member moves to the position that closes the control valve, based on the induced current generated due to the motion of the control valve member, while applying the second method current according to the second method, the second method being different than the first method.

2. The method according to claim 1, wherein the second method current is applied according to the second method between a pilot injection and a main injection.

3. The method according to claim 1, wherein the second method current is applied according to the second method between a main injection and a post injection.

4. The method according to claim 1, wherein the second method includes applying the second method current from a power source having a lower voltage than a power source applied during the first method.

5. The method according to claim 1, wherein the second method is performed at least until the control valve member returns to the position that closes the control valve, the position being a resting position.

6. The method according to claim 1, wherein the second method is applied at a timing that at least partially overlaps an injection of fuel.

7. The method according to claim 1, wherein the second method includes discontinuing an application of the second method current to a spill valve solenoid and the first method includes increasing the first method current applied to the spill valve solenoid immediately prior to the second method.

8. The method according to claim 1, wherein the timing of the closing of the control valve is detected by measuring a peak of the induced current induced by motion of the control valve member.

9. The method according to claim 1, further including modifying a trim of subsequent injection of fuel based on the detected timing of the closing of the control valve.

10. A fuel injection method for a mechanically-actuated electronically-controlled fuel injector having a spill valve and a control valve, comprising:

applying a chopped spill valve current to close the spill valve according to a first method;

applying a control valve current to cause a control valve member of the control valve to move from a first position to a second position;

stopping the application of the control valve current to cause the control valve member to return to the first position from the second position;

switching the chopped spill valve current to a non-chopped spill valve current to maintain the spill valve closed, according to a second method; and detecting a timing of the return of the control valve member to the first position while applying the non-chopped spill valve current.

11. The fuel injection method of claim 10, wherein the chopped spill valve current is repeatedly cycled between connected and disconnected states and the non-chopped spill valve current is applied by a battery that remains connected while performing the second method.

12. The fuel injection method of claim 10, wherein the return of the control valve member to the first position is detected while the non-chopped spill valve current is applied to a spill valve solenoid.

13. The fuel injection method of claim 10, further including modifying a trim of subsequent injection of fuel based on the detected timing of the return of the control valve to the first position by adjusting at least one of a duration or a dwell of the subsequent injection.

14. A fuel injection control system, comprising:

at least one power source;

a fuel injector including a spill valve including a spill valve solenoid, and a control valve including a control valve solenoid and a control valve member; and a controller configured to:

apply a chopped current to the spill valve solenoid according to a first method;

apply a control valve current to the control valve solenoid to open a control valve;

discontinue the application of the control valve current to the control valve solenoid;

cause generation of an induced current by discontinuing the application of the control valve current, the induced current being generated due to motion of the control valve member to a position that causes the control valve to close;

apply a non-chopped current to hold the spill valve closed according to a second method; and detect a timing of a closing of the control valve by monitoring the induced current generated due to the motion of the control valve member, while applying the non-chopped current according to the second method, wherein the second method has a lower cross-talk potential than the first method.

15. The control system according to claim 14, wherein the power source is a first power source and wherein the fuel injection control system further includes a second power source having a voltage lower than a voltage of the first power source.

16. The control system according to claim 15, wherein the controller is configured to apply the chopped current from the first power source to the spill valve solenoid by repeatedly connecting and disconnecting the first power source and the second power source includes a battery.

17. The control system according to claim 14, wherein the controller is configured to control a timing of a subsequent fuel injection according to the detected timing of the closing of the control valve.

18. The control system according to claim 14, wherein the controller is configured to detect the timing of the closing of the control valve between a pilot injection and a main injection or between the main injection and a post injection.

19. The control system according to claim 14, wherein the controller is configured to adjust a timing of beginning the application of non-chopped current based on a previously-detected timing of the closing of the control valve.

20. The control system according to claim 14, wherein the controller is configured to adjust a duration of the application of non-chopped current based on a previously-detected timing of the closing of the control valve.

* * * * *